US005711177A

United States Patent [19]

Mitsubayashi et al.

[11] Patent Number: 5,711,177

[45] Date of Patent: Jan. 27, 1998

[54] METHOD FOR CORRUGATING A METALLIC PIPE

[75] Inventors: Masahiko Mitsubayashi, Nagoya; Masazumi Ohnishi, Toyota; Noritaka Miyamoto, Toyota; Shinobu Ishida, Toyota; Shinji Kawasaki, Toyota; Shoichiro Nitta, Aichi-ken, all of Japan

[73] Assignee: Toyota Jidosha Kabushiki Kaisha, Toyota, Japan

[21] Appl. No.: 671,180

[22] Filed: Jun. 27, 1996

[51] Int. Cl.[6] ..... B21D 31/04

[52] U.S. Cl. ..... 72/342.1

[58] Field of Search ..... 72/302, 342.1, 72/342.5, 342.6, 342.94

[56] References Cited

U.S. PATENT DOCUMENTS

| | | | |
|---|---|---|---|
| 425,022 | 4/1890 | Burkhardt | 72/302 |
| 653,354 | 7/1900 | Maciejewski | 72/342.1 |
| 2,055,535 | 9/1936 | Hopkins | 72/342.1 |
| 3,198,928 | 8/1965 | Allison | 72/342.1 |
| 4,821,551 | 4/1989 | Ogino et al. . | |
| 4,843,857 | 7/1989 | Krieps | 72/342.94 |

FOREIGN PATENT DOCUMENTS

| | | | |
|---|---|---|---|
| 62-142030 | 6/1987 | Japan . | |
| 62-259623 | 11/1987 | Japan . | |
| 62-275527 | 11/1987 | Japan . | |
| 63-85319 | 6/1988 | Japan . | |
| 64-2733 | 1/1989 | Japan . | |
| 1-192425 | 8/1989 | Japan . | |
| 2-121828 | 5/1990 | Japan . | |
| 2-211913 | 8/1990 | Japan . | |
| 3-138024 | 6/1991 | Japan . | |
| 4-91824 | 3/1992 | Japan . | |
| 4-172132 | 6/1992 | Japan . | |
| 6-55225 | 3/1994 | Japan . | |
| 6-55226 | 3/1994 | Japan . | |
| 6-182456 | 7/1994 | Japan . | |
| 7-80572 | 3/1995 | Japan . | |
| 7-88566 | 4/1995 | Japan . | |
| 7-232218 | 9/1995 | Japan . | |
| 1375391 | 2/1988 | U.S.S.R. | 72/342.94 |

*Primary Examiner*—Lowell A. Larson

*Attorney, Agent, or Firm*—Oblon, Spivak, McClelland, Maier & Neustadt, P.C.

[57] ABSTRACT

A method of corrugating a metallic pipe which achieves an increase in the limit of tube expansion ratios. First, a heated part is formed by heating a local part of an outer periphery of a pipe in a circumferential direction by a high frequency coil. Next, the heated part is located within a forming surface of a forming die, and an axial compressive stress is applied to the pipe. Thus, the heated part is expanded while restricted by the forming surface. Therefore, even when the axial length of the heated part is increased, formability is stabilized and the tube expansion ratio can be raised.

2 Claims, 11 Drawing Sheets

W: PIPE

1: HIGH FREQUENCY COIL

Wo : HEATED PART

2: FORMING DIE

2a: FORMING SURFACE

F, F' : COMPRESSING STRESS

METHOD FOR CORRUGATING A METALLIC PIPE

BACKGROUND OF THE INVENTION

1. Field of the Invention

This invention relates to a method for corrugating a metallic pipe, and more particularly to a method for expanding a local part of an outer periphery of a pipe formed of elastic metal in the shape of waves, folds or the like. A metallic pipe corrugated by the method of the present invention is suitably used for a steering shaft, an oil cooler tube, and the like.

2. Description of the Related Art

One of generally known methods for corrugating a metallic pipe is a cold bulging method in which a local part of an outer periphery of a pipe is expanded in the shape of convexes by the application of longitudinal compressive stresses to the pipe at room temperature. This cold bulging method is poor in machinability because this method requires large compressive stresses. Recently, other corrugating methods which are capable of solving this and other problems have been under development.

For instance, Japanese Utility Model Unexamined Publication (KOKAI) No.63-85319 discloses a method of forming a flared tube by expanding a local part of an outer periphery of a pipe in the shape of a convex at elevated temperatures without employing a die. In this hot dieless corrugating method, first a heated part is formed by heating in a circumferential direction a local part of an outer periphery of a pipe extending in an axial direction by a high frequency coil. Next, the heated part is expanded in the shape of a convex by applying an axial compressive stress to the pipe. When formation and expansion of heated parts are conducted at other locations, the local part of the outer periphery of the pipe is corrugated in the shape of waves.

In this hot dieless corrugating method, however, it has been apparent that tube expansion ratios (percentages of expanded tube outer diameters to original tube outer diameters) have low limits. This reason is supposed to be as follows: In the hot dieless corrugating method, as shown in FIG. 17, tensile stress T is exerted in a circumferential direction of a material constituting the pipe W, while compressive stress C is applied in the axial direction and the material is axially supplied to bulge the pipe. It must be noted that an increase in the limit of tube expansion ratios necessitates an increase in a forming allowance i.e., a displacement under an axial compressive stress, which inevitably requires a large axial length of a heated part. This, however, results in a wide variation in locations of local buckling. Especially when the axial length of a heated part is larger than the outer diameter of a pipe, formability becomes remarkably unstable. Unstable formability causes insufficient tube expansion ratios.

These insufficient tube expansion ratios are a big problem in view of purposes for using corrugated pipes. For example, when corrugated pipes are used as such members for absorbing a displacement or an impact as steering shafts and so on, displacement absorbing amounts or impact energy absorbing amounts largely depend on tube expansion ratios. For another example, when corrugated pipes are used as radiators such as oil cooler tubes, amounts of heat radiation per unit length are dependent on tube expansion ratios. Therefore, tubes having insufficient tube expansion ratios are inferior in performance.

By the way, Japanese Unexamined Patent Publication (KOKAI) No.62-259623 discloses a hot bulging method employing a die. Since no longitudinal compressive stress is applied to a pipe, this method has a difficulty in obtaining large tube expansion ratios.

Further, Japanese Unexamined Patent Publication (KOKAI) No.2-121828 also discloses a hot bulging method using a die. This method aims to bulge a resin hose. Since easy movement of a resin material scarcely requires a resin hose to specify a buckling position for an improvement in tube expansion ratios, this technique cannot be adopted to a method for corrugating a metallic pipe.

Furthermore, Japanese Unexamined Patent Publication (KOKAI) No.62-142030 discloses a hydraulic bulging method. In general, a hydraulic bulging method is a method of giving deformation by applying a tensile stress to a material. Therefore, the limit of processability is dependent on ductility of a tube material, and expansion beyond the processable limit results in a crack or the like on a bulged part. In addition, because the hydraulic bulging method deforms a pipe with inner pressure, the pipe material is elongated, and as pipe deformation is larger, the wall thickness of a pipe decreases sharply.

SUMMARY OF THE INVENTION

It is an object of the present invention to increase the limit of tube expansion ratios in a method for corrugating a metallic pipe.

A method for corrugating a metallic pipe according to a first aspect of the present invention comprises:

a heating step of heating in a circumferential direction a local part of an outer periphery of a metallic pipe extending in an axial direction, so as to form a heated part;

an expansion step of placing on the side of the outer periphery of the pipe a forming die having an inner surface which serves as a forming surface in such a manner to locate the heated part within the forming surface, and applying a compressive stress to the pipe in the axial direction, so that the heated part is expanded while restricted by the forming surface.

A method for corrugating a metallic pipe, according to a second aspect of the present invention comprises:

a heating step of heating in a circumferential direction a local part of an outer periphery of a metallic pipe extending in an axial direction so as to form a heated part;

a first expansion step of placing on the side of the outer periphery of the pipe a contact jig which has a pair of inner end surfaces which are aligned with each other in the axial direction and serve as contact surfaces, and contacting each of the contact surfaces with the heated part so as to cross a particular portion of the heated part, while applying a first compressive stress to the pipe in the axial direction, so that the heated part is first expanded; and a second expansion step of releasing the heated part from the contact with each of the contact surfaces and applying a second compressive stress to the pipe in the axial direction, so that the heated part is second expanded.

A method for corrugating a metallic pipe, according to a third aspect of the present invention comprises:

a first heating step of heating in a circumferential direction a local part of an outer periphery of a metallic pipe extending in an axial direction, so as to form a first heated part;

a first expansion step of applying a first compressive stress to the pipe in the axial direction, so as to expand the first heated part first;

a second heating step of heating the first heated part and a side of the first heated part in a circumferential direction, so as to form a second heated part; and a second expansion step of applying a second compressive stress to the pipe in the axial direction, so as to expand the second heated part second.

A method for corrugating a metallic pipe, according to a fourth aspect of the present invention comprises:

a heating step of heating in a circumferential direction a local part of an outer periphery of a metallic pipe extending in an axial direction, so as to form a heated part having a maximum temperature at a particular position; and an expansion step of applying a compressive stress to the pipe in the axial direction, so as to expand the heated part.

A method for corrugating a metallic pipe, according to a fifth aspect of the present invention comprises:

a heating step of heating in a circumferential direction a local part of an outer periphery of a metallic pipe extending in an axial direction; and an expansion step of applying a compressive stress to the pipe in the axial direction while applying inner pressure to the pipe, so as to expand the heated part.

Now, the operation of these methods according to the present invention will be described.

In the method according to the first aspect of the present invention, first in a heating step, a heated part is formed by heating in a circumferential direction a local part of an outer periphery of a pipe extending in an axial direction.

Next, in an expansion step, a forming die having an inner surface which serves as a forming surface is placed on the side of the outer periphery of the pipe in such a manner to locate the heated part within the forming surface, and a compressive stress in the axial direction is applied to the pipe. Thus, the heated part is expanded while restricted by the forming surface.

In this expansion step, even when the axial length of the heated part is made larger than the outer diameter of the pipe in the heating step, the position of buckling is corrected by the forming surface and shows little locational variation. Therefore, formability is stabilized and the limit of tube expansion ratios can be raised by increasing the axial length of the heated part to enlarge a forming allowance.

In the method according to the second aspect of the present invention, first in a heating step, a heated part is formed by heating in a circumferential direction a local part of an outer periphery of a pipe extending in an axial direction.

Next, in a first expansion step, a contact jig having a pair of inner end surfaces which are axially aligned with each other and serve as contact surfaces is placed on the side of the outer periphery of the pipe, and each of the contact surfaces comes in contact with the heated part so as to cross a particular portion of the heated part. At the same time, a first compressive stress in the axial direction is applied to the pipe. Thus, the heated part is first expanded.

In this first expansion step, even when the axial length of the heated part is made larger than the outer diameter of the pipe in the heating step, buckling occurs at a particular position which the contact surfaces cross, and shows little locational variation.

Next, in a second expansion step, after the heated part is released from the contact with each of the contact surfaces, a second compressive stress in the axial direction is applied to the pipe. In this way, the heated part is second expanded.

Since large second expansion at the particular position can be secured, formability is stabilized. Even when the axial length of the heated part is increased to enlarge a forming allowance, superior formability is maintained. Therefore, it is possible to raise the limit of tube expansion ratios.

In the method according to the third aspect of the invention, first, in a first heating step, a first heated part is formed by heating in a circumferential direction a local part of an outer periphery of a pipe extending in an axial direction.

Next, in a first expansion step, a first compressive stress in the axial direction is applied to the pipe, so as to expand the first heated part first. Accordingly, the position of buckling is specified at the first heated part.

Then, in a second heating step, a second heated part is formed by heating in a circumferential direction the first heated part and a side of the first heated part.

After that, in a second expansion step, a second compressive stress in the axial direction is applied to the pipe, so as to expand the second heated part second.

Thus, even when the axial length of the second heated part is made larger than the outer diameter of the pipe in the second heating step, the position of buckling is specified at the first heated part and has little locational variation. Therefore, formability is stabilized and the limit of tube expansion ratios can be improved by increasing the axial length of the second heated part to increase a forming allowance.

In the method according to the fourth aspect of the present invention, first in a heating step, a heated part having a maximum temperature at a particular position is formed by heating in a circumferential direction a local part of an outer periphery of a pipe extending in an axial direction.

Then, in an expansion step, a compressive stress in the axial direction is applied to the pipe, so as to expand the heated part.

Since the heated part has a maximum temperature at a particular position, yield stress at the particular position is lower than that of the heated part at other positions. Therefore, the position of buckling is specified at the particular position, and has little locational variation. Therefore, formability is stabilized, and the limit of tube expansion ratios can be improved by increasing the axial length of the heated part to enlarge a forming allowance.

In the method according to the fifth aspect of the present invention, first in a heating step, a heated part is formed by heating in a circumferential direction a local part of an outer periphery of a pipe extending in an axial direction.

Next, in an expansion step, the heated part is expanded by applying a compressive stress in the axial direction to the pipe, while applying inner pressure to the pipe.

This inner pressure facilitates buckling to be caused at the center of the heated part, and the buckling position has little locational variation. Therefore, formability is stabilized and the limit of tube expansion ratios can be raised by increasing the axial length of the heated part to increase a forming allowance. In addition, inner pressure elongates the material and further improves tube expansion ratios.

In summary, the methods of corrugating a metallic pipe according to the first to fifth aspects of the present invention achieve an increase in the limit of tube expansion ratios owing to the above construction.

Particularly, the method of corrugating a metallic pipe according to the fifth aspect of the present invention attains the control of tube wall thickness by the adjustment of inner pressure.

BRIEF DESCRIPTION OF THE DRAWINGS

A more complete appreciation of the present invention and many of its advantages will be readily obtained as the same becomes better understood by reference to the following detailed description when considered in connecting with the accompanying drawings and detailed specification, all of which forms a part of the disclosure.

PREFERRED EMBODIMENTS OF THE PRESENT INVENTION

Having generally described the present invention, a further understanding can be obtained by reference to the specific preferred embodiments which are provided herein for purposes of illustration only and are not intended to limit the scope of the appended claims.

The First Preferred Embodiment

A First Preferred Embodiment is an embodiment of the first aspect of the present invention.

Figure 1:
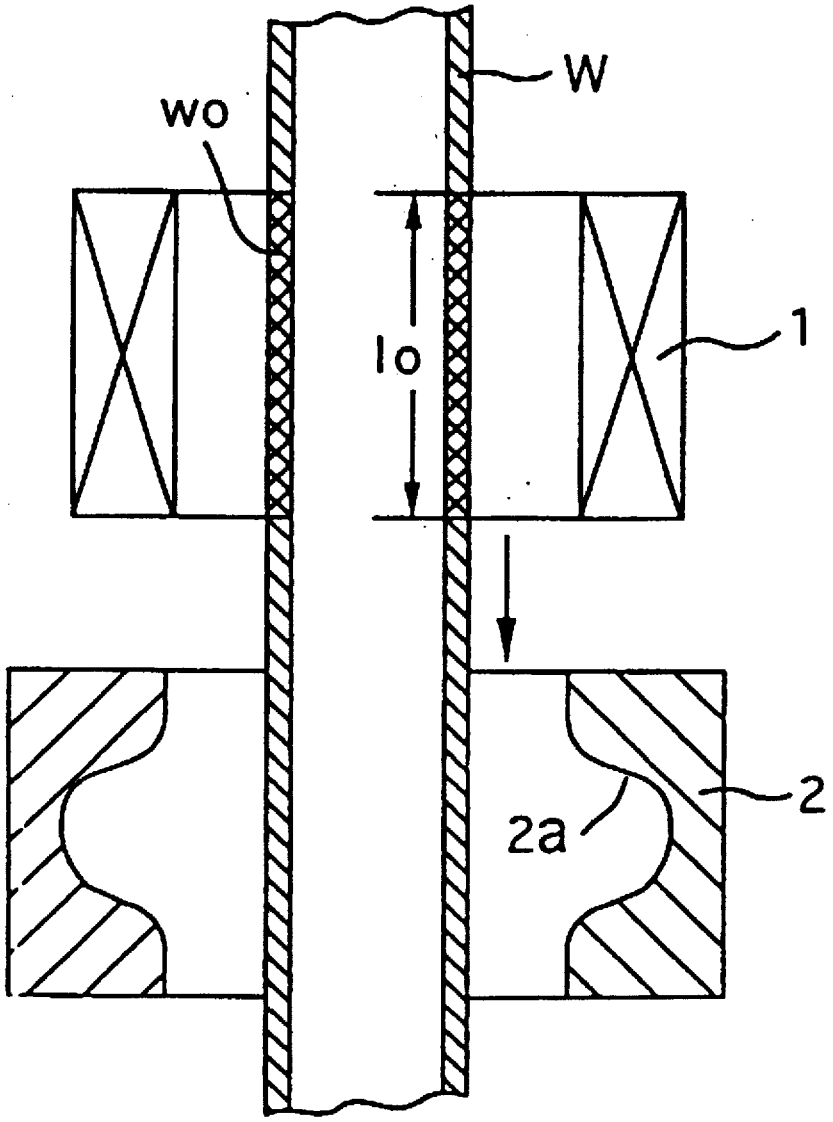
FIG. 1 is a cross section of a part of a pipe and a forming apparatus in a heating step of a method according to a first preferred embodiment of the present invention.

First, a pipe W formed of aluminum and extending in an axial direction was prepared as shown in FIG. 1. This pipe W was a drawn tube formed of a material according to JIS-A3003H18 and having an outer diameter of 12.7 mm and a wall thickness of 1.2 mm. This pipe W was fixed to a pair of fixed chucks (not shown) of a forming apparatus. In this forming apparatus, a high frequency coil 1 is provided between the pair of fixed chucks, and a forming die 2 which was radially divided into three parts was located below the high frequency coil 1. Inner surfaces of the forming die 2 served as forming surfaces 2*a* having an axial length of 13 mm. The forming surfaces 2*a* were deepest at the axial center, and formed in vertical symmetry with respect to the center. The pipe W was located in the high frequency coil 1 and the forming die 2.

<The Heating Step>

A local part of an outer periphery of the pipe W was heated by the high frequency coil 1 in a circumferential direction. The frequency used was 40 kHz, the heating temperature was approximately 600° C., and the heating time was 1 second. Thus, a heated part $W_o$ having an axial length $l_o$ of 13 mm was formed on the pipe W.

<The Expansion Step>

Figure 2:
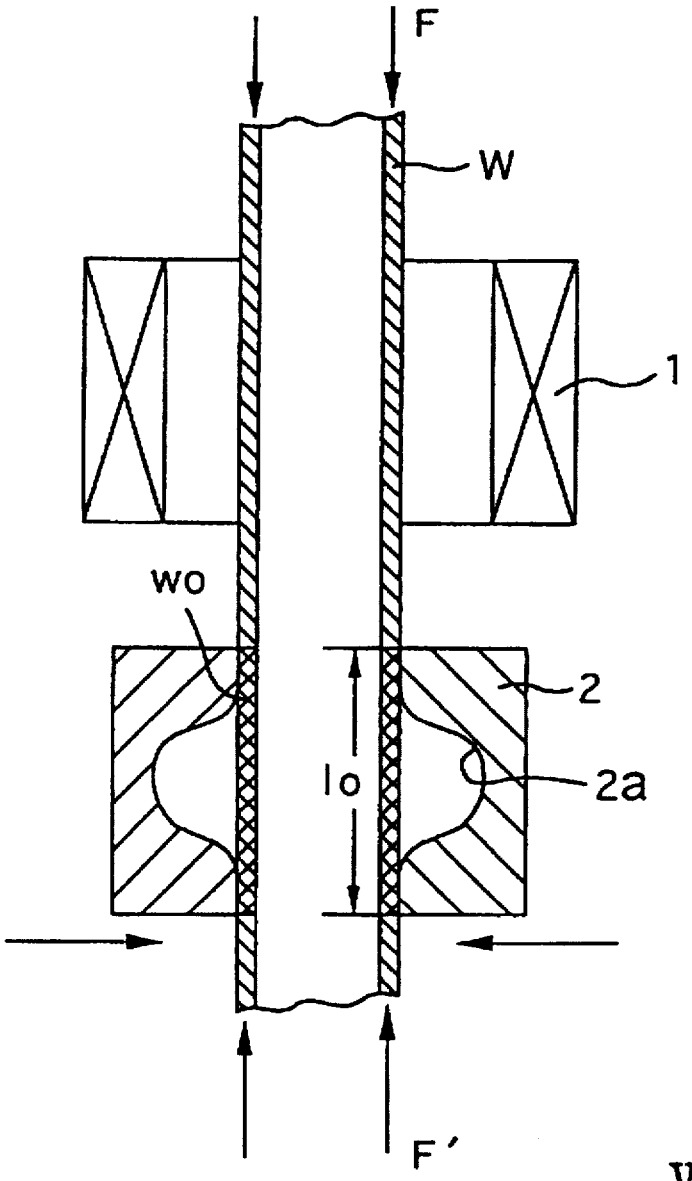
FIG. 2 is a cross section of a part of the pipe and the forming apparatus before expansion in an expansion step of the method according to the first preferred embodiment of the present invention.

Immediately after the heating step, as shown in FIG. 2, the pipe W was transferred in the axial direction so as to locate the heated part $W_0$ within the forming surfaces 2*a* of the forming die 2, and the forming die 2 was closed. Then compressive stresses F and F' (F' was a reaction of F) in the axial direction were applied to the pipe W. At this time, the forming allowance (the axial displacement under stress) was 7 mm, and the loading speed was 200 mm/second. Thus, the heated part $W_0$ was expanded while restricted by the forming surfaces 2*a*, as shown in FIG. 3.

Figure 3:
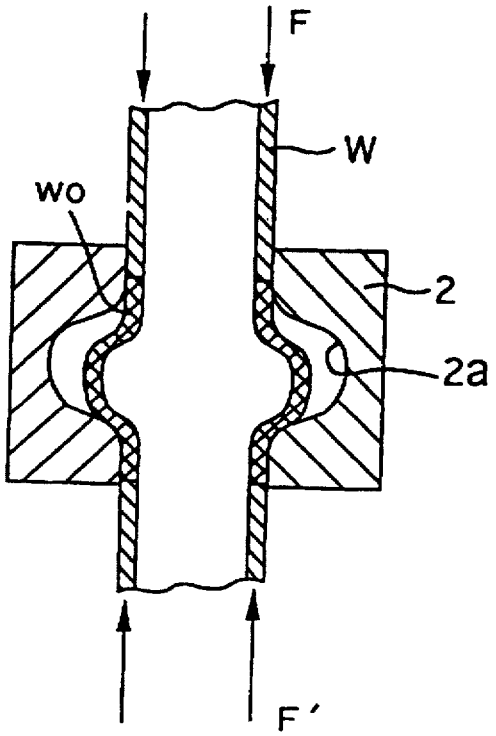
FIG. 3 is a cross section of a part of the pipe and the forming apparatus in an initial stage of the expansion step of the method according to the first preferred embodiment of the present invention.
Figure 4:
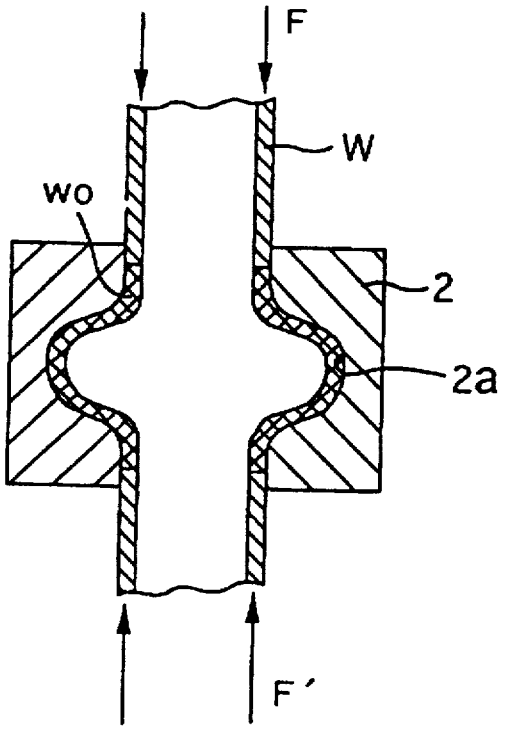
FIG. 4 is a cross section of a part of the pipe and the forming apparatus in a middle of the expansion step of the method according to the first preferred embodiment of the present invention.

In this expansion step, since the axial length of the heated part $W_0$ was made larger than the outer diameter of the pipe in the heating step, the position of buckling varied at an initial stage of expansion as shown in FIG. 3. As shown in FIG. 4, however, as the expansion proceeds, the buckling position was corrected by the forming surfaces 2*a* so as to locate the peak of the diameter enlarged part at the center, and showed little locational variation.

On the other hand, when a pipe W of the same kind was corrugated by the above conventional hot dieless corrugating method, the maximum outer diameter of an expanded part which could be stably formed was 18.5 mm and tube expansion ratios have a limit of approximately 45%.

In this respect, in the case where the pipe W was corrugated by the method of this preferred embodiment, even when the forming allowance was enlarged by increasing the axial length of the heated part $W_0$, stable formability was obtained owing to the correction of buckling positions, and expansion at a tube expansion ratio of 53% was attained.

Consequently, it was apparent that this method of corrugating a pipe could raise the limit of tube expansion ratios.

It must be noted that the pipe could be corrugated by displacing the high frequency coil 1 and the forming die 2 axially instead of displacing the pipe W axially.

The Second Preferred Embodiment

A Second Preferred Embodiment is an embodiment of the second aspect of the present invention.

Figure 5:
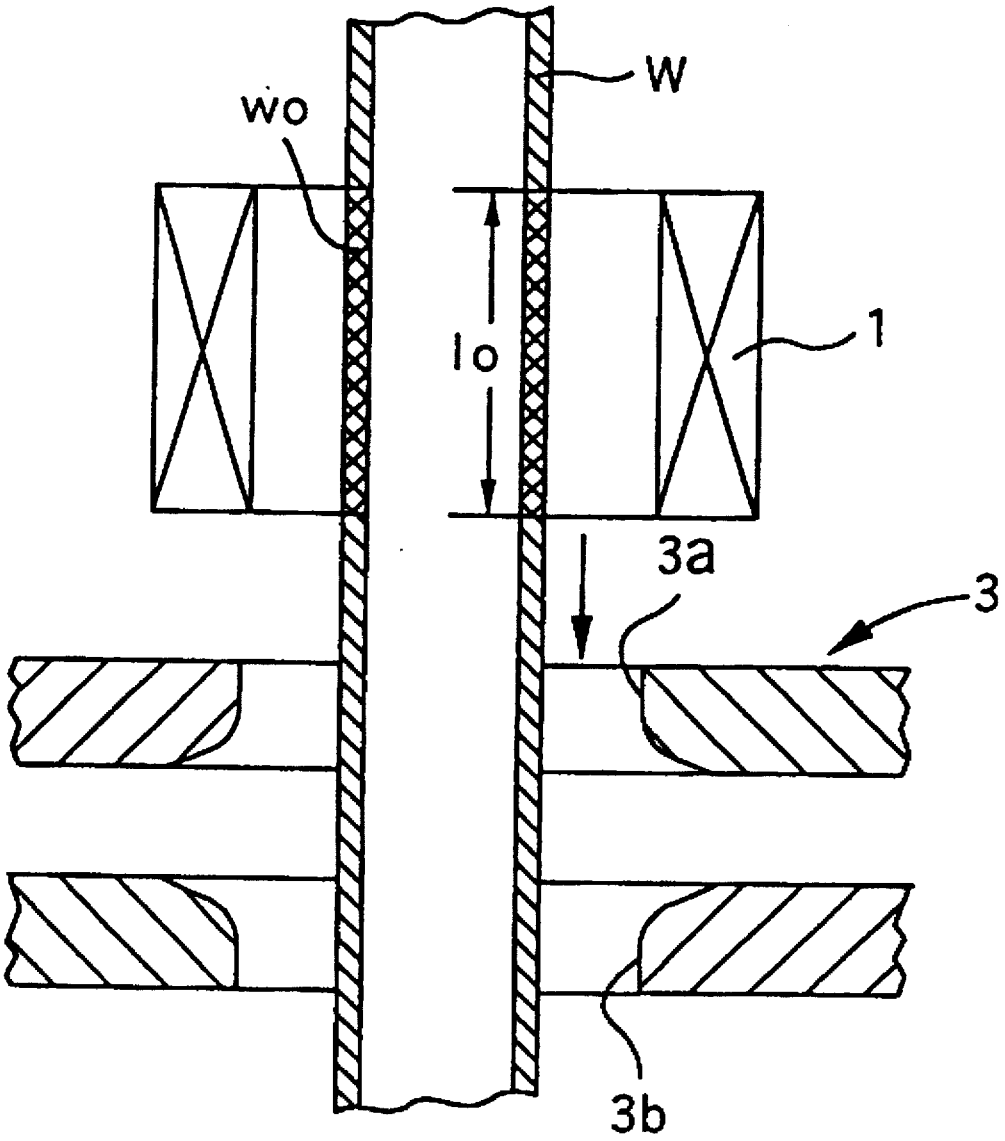
FIG. 5 is a cross section of a part of a pipe and a forming apparatus in a heating step of a method according to a second preferred embodiment of the present invention.
Figure 6:
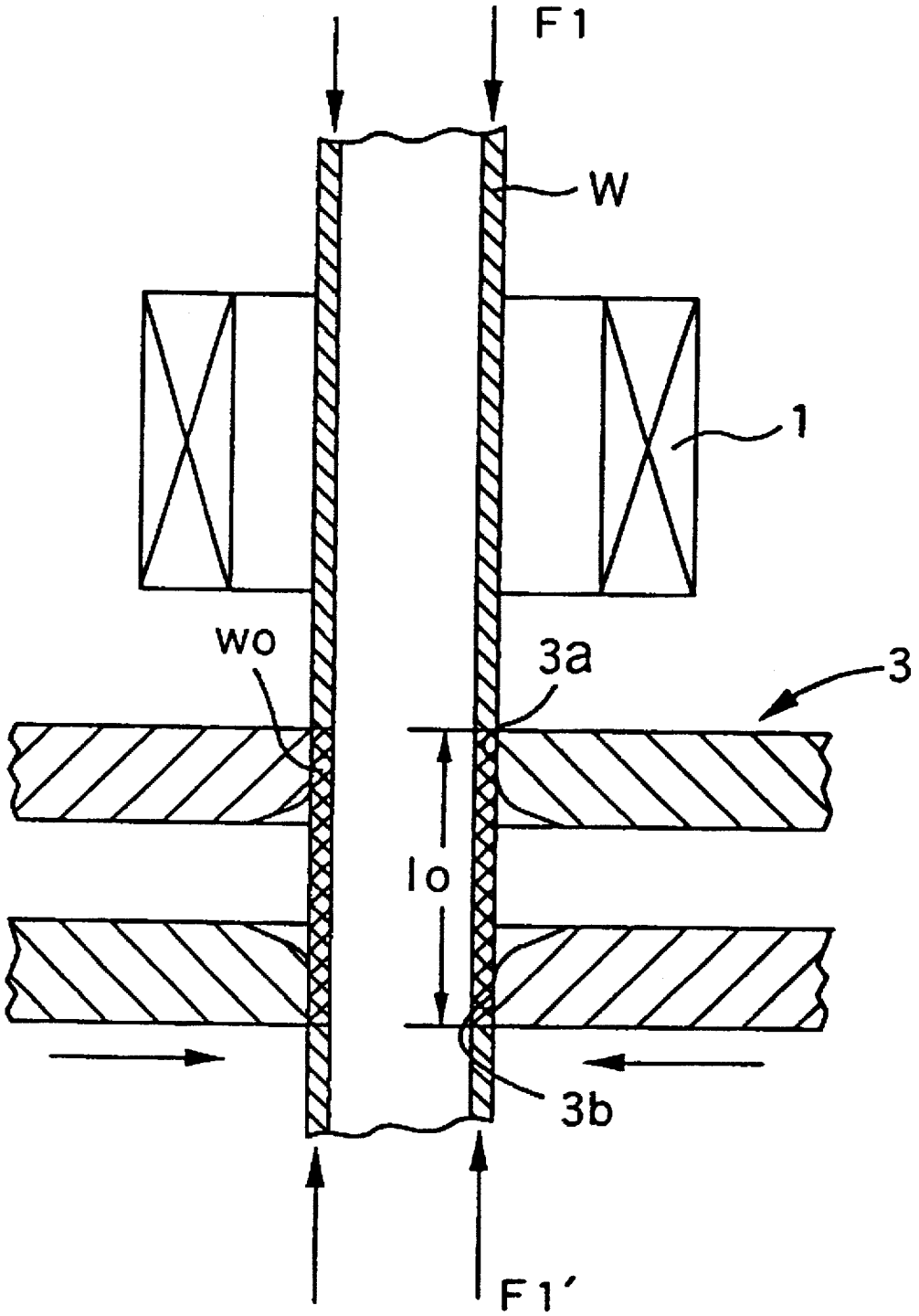
FIG. 6 is a cross section of a part of the pipe and the forming apparatus before expansion in a first expansion step of the method according to the second preferred embodiment of the present invention.

First, a pipe W of the same kind as used in the First Preferred Embodiment was prepared as shown in FIG. 5. This pipe W was fixed to a pair of fixed chucks (not shown) of a forming apparatus. In this forming apparatus, a high frequency coil 1 existed between the pair of fixed chucks, and a contact jig 3 which was axially divided into two and radially divided into three was provided below the high frequency coil 1. A pair of inner end surfaces of the contact jig 3 in axial alignment with each other served as contact surfaces 3*a*, 3*b*. Each of the contact surfaces 3*a*, 3*b* was formed in parallel to the axial direction, and has a curve on a side close to each other. Each of the contact surfaces 3*a*, 3*b* had an axial length of 3 mm. The pipe W was located in the high frequency coil 1 and the contact jig 3.

<The Heating Step>

A heated part $W_0$ having an axial length $l_0$ of 16 mm was formed on the pipe W by the high frequency coil 1 in the same way as in the First Preferred Embodiment.

<The First Expansion Step>

Immediately after the heating step, the pipe W was relatively displaced in the axial direction so as to locate the heated part $W_0$ within the contact surfaces 3*a*, 3*b*, and the contact jig 3 was closed. At this time, each of the contact surfaces 3*a*, 3*b* was brought in contact with the heated part $W_0$ in such a manner to cross the center of the heated part $W_0$.

Figure 7:
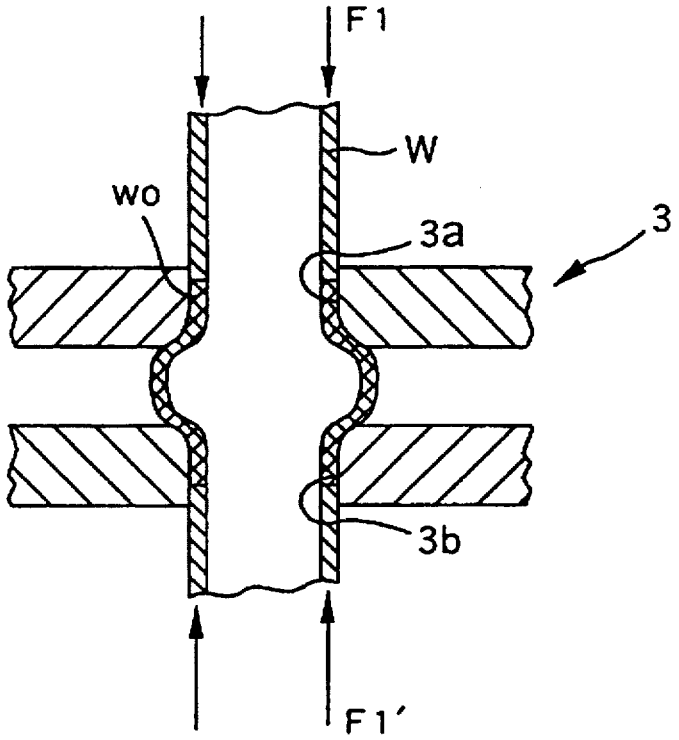
FIG. 7 is a cross section of a part of the pipe and the forming apparatus after expansion in the first expansion step of the method according to the second preferred embodiment of the present invention.

Then, first compressive stresses $F_1$, $F_1'$ ($F_1'$ was a reaction of $F_1$) in the axial direction were applied to the pipe W. The loading speed was 200 mm/sec. Thus, as shown in FIG. 7, the heated part $W_0$ was first expanded only by a forming allowance of 2 mm, while the heated part $W_0$ was in contact with the respective contact surfaces 3*a* and 3*b*.

In the first expansion step, even when the axial length of the heated part $W_0$ was made larger than the outer diameter of the pipe W in the heating step, the position of buckling was always specified at the center of the heated part $W_0$, and had little locational variation.

<The Second Expansion Step>

Figure 8:
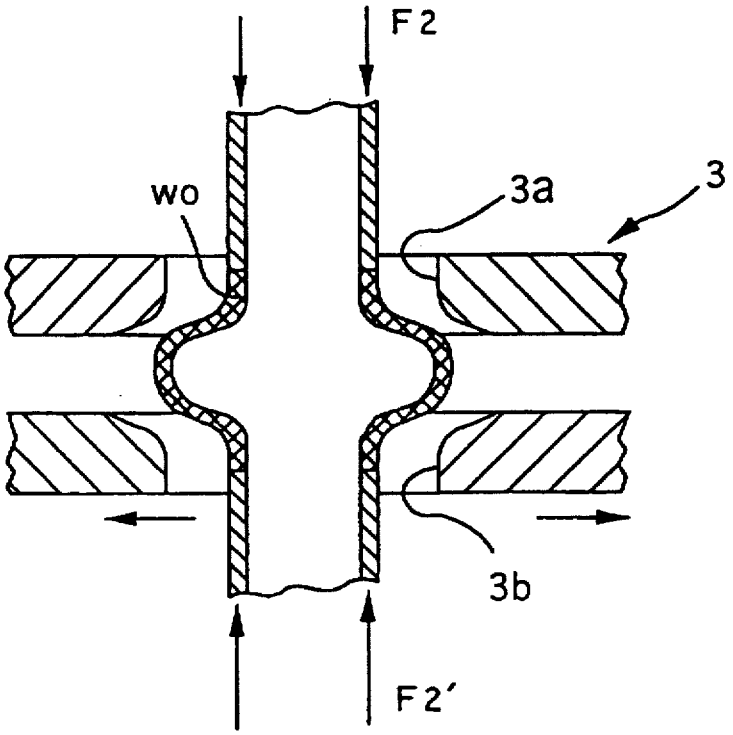
FIG. 8 is a cross section of a part of the pipe and the forming apparatus in a second expansion step of the method according to the second preferred embodiment of the present invention.

Immediately after the first expansion step, the contact jig 3 was opened and the heated part $W_0$ was released from the contact with the respective contact surfaces 3*a*, 3*b*, as shown in FIG. 8.

Then, second compressive stresses $F_2$, $F_2'$ ($F_2'$ was a reaction of $F_2$) in the axial direction were applied to the pipe W. The forming allowance was 6 mm, and the loading speed was 200 mm/sec. Thus, the heated part $W_0$ was second expanded.

Since large second expansion could be secured at the center of the heated part $W_0$, formability was stabilized. Accordingly, even when the axial length of the heated part $W_0$ was increased to enlarge a forming allowance, stable formability was obtained. Therefore, expansion at a tube expansion ratio of 60% was achieved.

The Third Preferred Embodiment

A Third Preferred Embodiment is an embodiment of the third aspect of the present invention.

Figure 9:
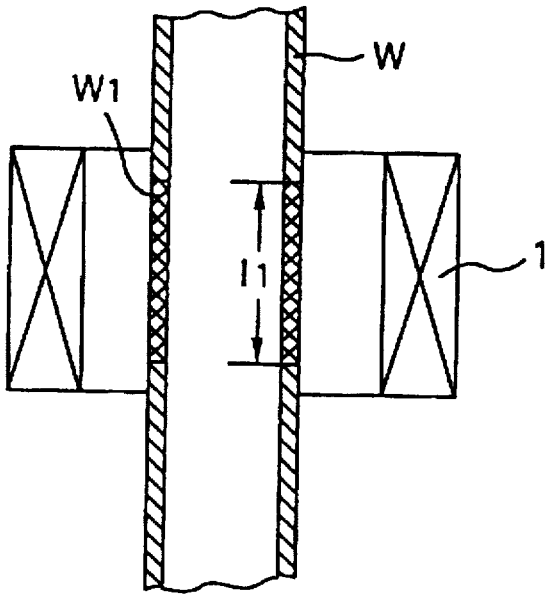
FIG. 9 is a cross section of a part of a pipe and a forming apparatus in a first heating step of a method according to a third preferred embodiment of the present invention.

First, a pipe W of the same kind as used in the First Preferred Embodiment was prepared, as shown in FIG. 9. This pipe W was fixed to a pair of fixed chucks (not shown) of a forming apparatus. This forming apparatus had a high frequency coil 1 between the pair of fixed chucks. The pipe W was located in the high frequency coil 1.

<The First Heating Step>

A first heated part $W_1$ having an axial length $l_1$ of 12 mm was formed on the pipe W by the high frequency coil 1. The frequency used was 40 kHz, the heating temperature was approximately 600° C., and the heating time was 0.7 second.

<The First Expansion Step>

Figure 10:
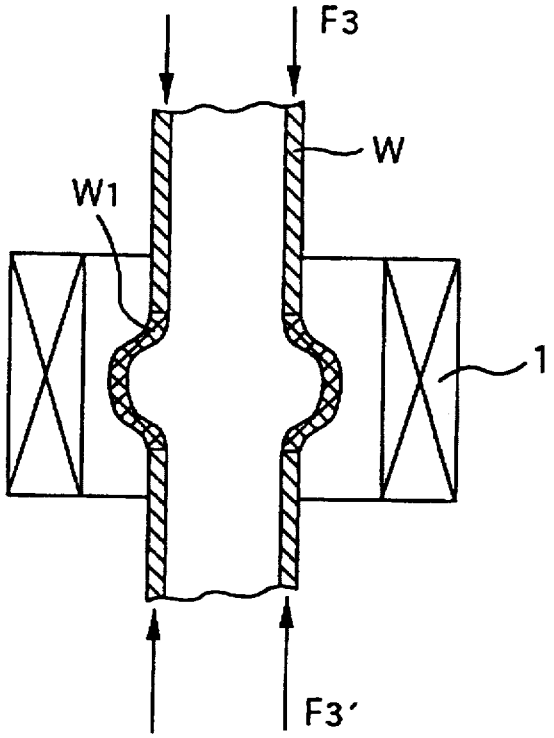
FIG. 10 is a cross section of a part of the pipe and the forming apparatus in a first expansion step of the method according to the third preferred embodiment of the present invention.

Immediately after the first heating step, first compressive stresses $F_3$, $F_3'$ ($F_3'$ was a reaction of $F_3$) in the axial direction were applied to the pipe W, as shown in FIG. 10. The loading speed was 200 mm/sec. Thus, the first heated part $W_1$ was first expanded only by a forming allowance of 1 mm, so that the position of buckling was specified at the first heated part $W_1$.

<The Second Heating Step>

Figure 11:
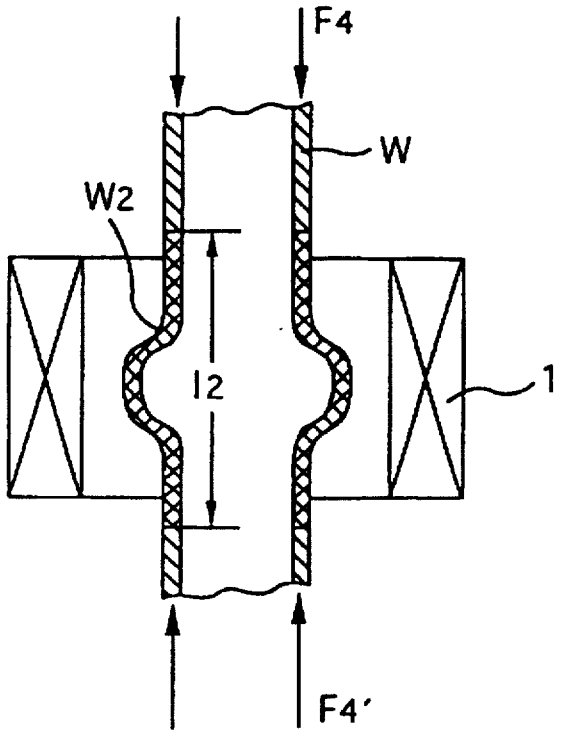
FIG. 11 is a cross section of a part of the pipe and the forming apparatus in a second heating step of the method according to the third preferred embodiment of the present invention.

As shown in FIG. 11, a second heated part $W_2$ having an axial length $l_2$ of 17 mm was formed on the pipe W by the high frequency coil 1, while the pipe W kept the same position. The frequency used was 40 kHz, the heating temperature was about 600° C., and the heating time was 2.0 seconds.

<The Second Expansion Step>

Figure 12:
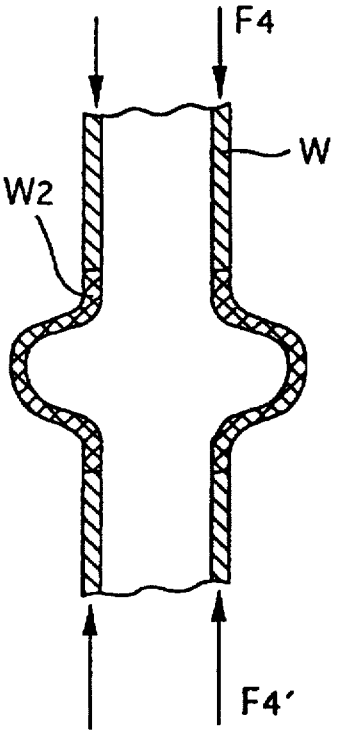
FIG. 12 is a cross section of a part of the pipe and the forming apparatus in a second expansion step of the method according to the third preferred embodiment of the present invention.

Immediately after the second heating step, second compressive stresses $F_4$, $F_4'$ ($F_4'$ was a reaction of $F_4$) in the axial direction were applied to the pipe W. The loading speed was 200 m/sec. Thus, the second heated part $W_2$ was expanded as shown in FIG. 12.

Even when the axial length of the second heated part $W_2$ was made larger than the outer diameter of the pipe W in the second heating step, the position of buckling was specified at the first heated part $W_1$, and showed little locational variation. Therefore, formability was stabilized, and an increase in the axial length of the second heated part $W_2$ to increase a forming allowance achieved expansion at a tube expansion ratio of 64%.

Although the same high frequency coil 1 was employed to conduct the first and second heating steps by the adjustment of output and heating time, it was possible to adopt mobile heating by displacing the pipe W relatively, or to employ two different types of high frequency coils having different axial length.

The Fourth Preferred Embodiment

A Fourth Preferred Embodiment is an embodiment of the fourth aspect of the present invention.

Figure 13:
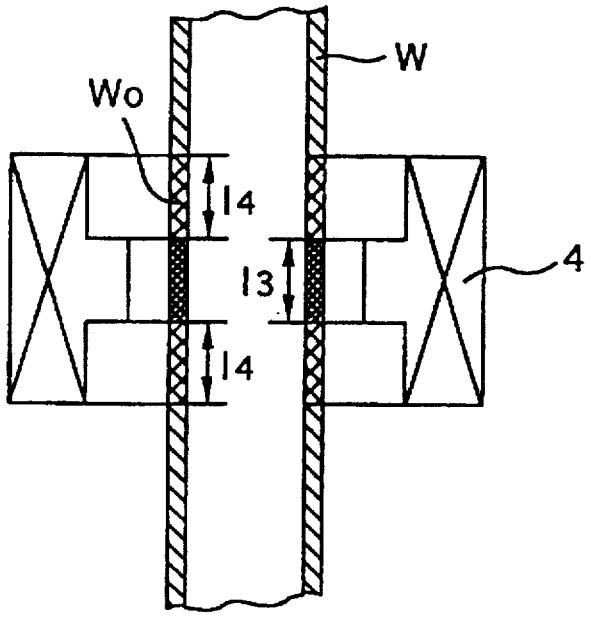
FIG. 13 is a cross section of a part of a pipe and a forming apparatus in a heating step of a method according to a fourth preferred embodiment of the present invention.

First, a metallic pipe W extending in an axial direction was prepared as shown in FIG. 13. This pipe W was formed of stainless steel according to JIS-SUS430, and had an outer diameter of 28.6 mm and a wall thickness of 1.2 mm. This pipe W was attached to a pair of fixed chucks (not shown) of a forming apparatus. This forming apparatus had a high frequency coil 4 between the pair of fixed chucks. A central portion of this high frequency coil 4 had a decreased diameter for an axial length of 10 mm, so that the center of a heated part attained a temperature of 1,000° C. The pipe W was located in the high frequency coil 4.

<The Heating Step>

A local part of an outer periphery of the pipe W was heated in a circumferential direction by the high frequency coil 4. The frequency used was 40 kHz, the heating temperature was about 1,000° C. at the maximum, and the heating time was one second. Thus, the pipe W attained a heated part $W_0$ which comprises a central portion having a temperature of 1000° C. and an axial length $l_3$ of 10 mm, and end portions connected to the central portion and each having a temperature of 950° C. and an axial length $l_4$ of 12 mm.

<The Expansion Step>

Immediately after the heating step, a compressive stress in the axial direction was applied to the pipe W. The loading speed was 200 mm/sec. Thus, the heated part $W_2$ was expanded, as shown in FIG. 12.

Since the central portion of the heated part $W_2$ has a temperature of approximately 1,000° C., yielding stress of the central portion was lower than that of the end portions of the heated part $W_2$. Therefore, the position of buckling was specified at the central portion, and showed little locational variation. Consequently, formability was stabilized, and an increase in the axial length of the heated part $W_2$ to enlarge a forming allowance enabled expansion at a tube expansion ratio of 53%.

The Fifth Preferred Embodiment

A Fifth Preferred Embodiment is an embodiment of the fifth aspect of the present invention.

Figure 14:
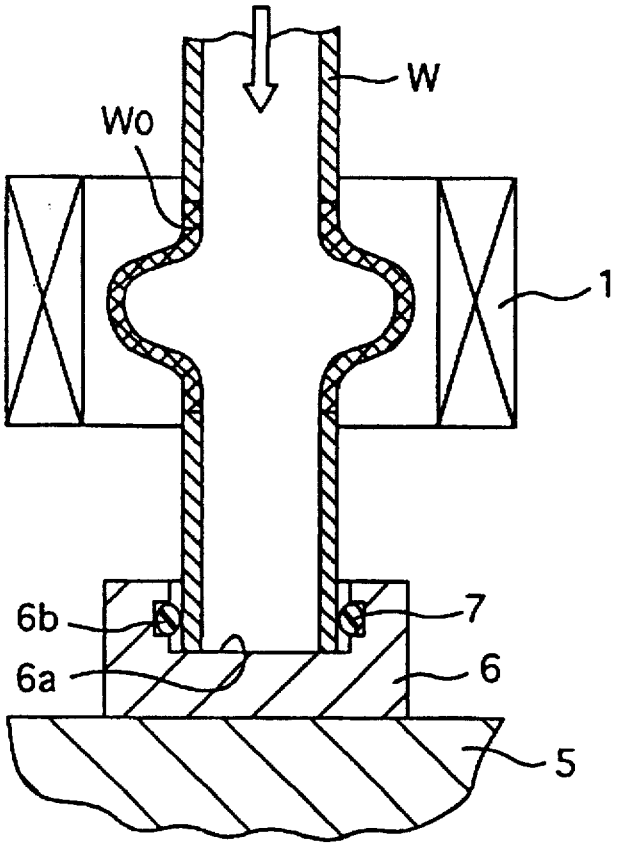
FIG. 14 is a cross section of a part of a pipe and a forming apparatus in an expansion step of a method according to a fifth preferred embodiment of the present invention.

First, a pipe W of the same kind as used in the Fourth Preferred Embodiment was used as shown in FIG. 14. This pipe W was attached to a pair of fixed chucks (not shown) of a forming apparatus. In this forming apparatus, a high frequency coil 1 of the same kind as used in the First Preferred Embodiment was provided between the pair of fixed chucks, and below the high frequency coil 1 there was a sealing base 6 fixed on a base plate 5. The sealing base 6 had a circular hole 6*a* into which a lower end of the pipe W was inserted. An annular groove 6*b* was formed on a peripheral wall of the circular hole 6*a*, and an O-ring 7 was provided in the annular groove 6*b*. The pipe W was located in the high frequency coil 1 and the circular hole 6*a* of the sealing base 6.

<The Heating Step>

A heated part $W_0$ having an axial length $L_0$ of 30 mm was formed on the pipe W by the high frequency coil 1 in the same way as in the First Preferred Embodiment.

<The Expansion Step>

Immediately after the heating step, while compressed air at 10 kgf/cm$^2$ was supplied from an upper end of the pipe W, a compressive stress in the axial direction was applied to the pipe W. The forming allowance was 9 mm, and the loading speed was 200 mm/sec. As shown in FIG. 12, the heated part $W_2$ was thus expanded.

At this time, buckling tends to occur at the center of the heated part $W_2$ due to the pressure of the compressed air, and the buckling position showed little locational variation. Therefore, formability was stabilized, and an increase in the axial length of the heated part $W_2$ to increase a forming allowance, and elogation of the material by the compressed air achieved expansion at a tube expansion ratio of 55%.

In the conventional hot dieless corrugating method, because compression supplies the material in the axial direction, an expanded part gets some increase in the wall thickness. Although whether this increase in the wall thickness produces a good effect or a bad effect depends on the use of a corrugated pipe, this conventional hot dieless corrugating method does not positively control the wall thickness of a pipe, and it is difficult to obtain a desirable wall thickness of an expanded part which product characteristics demand.

In this respect, in the method of this preferred embodiment, an increase in the forming allowance functions to increase the wall thickness, and inner pressure acts to decrease the wall thickness of the forming allowance. Therefore, the adjustment of inner pressure allows control of the wall thickness of the forming allowance.

In the method of this preferred embodiment, the adjustment of compressed air enabled the wall thickness of the expanded part to remain approximately constant.

As a method for applying inner pressure, it is possible to employ a method of feeding a pressure medium such as gas, liquid, solid, and mixtures thereof to a pipe. Examples of suitable pressure media are air, carbon dioxide, nitrogen, oil, water, sand, various powders, and the like. As another method for applying inner pressure, it is possible to use a method of spreading water absorbing resin on the inside of the pipe, conducting a heating step with both ends of the pipe sealed, so as to use vaporizing pressure of water contained in the water absorbing resin.

It is also possible to combine the methods according to the first to fifth aspects of the present invention. In the methods of the first to fifth aspects of the present inventions, formation and expansion of heated parts are conducted at other locations, it is possible to bulge a local part of an outer periphery of a pipe in the shape of waves.

A combination of the method of the Fifth Preferred Embodiment and the method of the Fourth Preferred Embodiment exhibited an effect of improving the limit of the respective tube expansion ratios by several percentages.

The Sixth Preferred Embodiment

A Sixth Preferred Embodiment is also an embodiment of the fifth aspect of the present invention.

In the Sixth Preferred Embodiment, an axial compressive stress was applied to a pipe W, while pressure sand at a pressure of 24 kgf/cm$^2$ was supplied from an upper end of the pipe W. Construction other than the above was the same as that of the Fifth Preferred Embodiment.

An increase in the axial length of a heated part $W_0$ to enlarge a forming allowance and elogation of a tube material by the pressure sand achieved expansion at a tube expansion ratio of 60%.

This method allowed the wall thickness of an expanded part to be controlled in the range from 1.0 to 1.4 mm owing to the balance of the inner pressure and the compressive stress.

The Seventh Preferred Embodiment

A Seventh Preferred Embodiment is an embodiment of the first and fifth aspects of the present invention.

Figure 15:
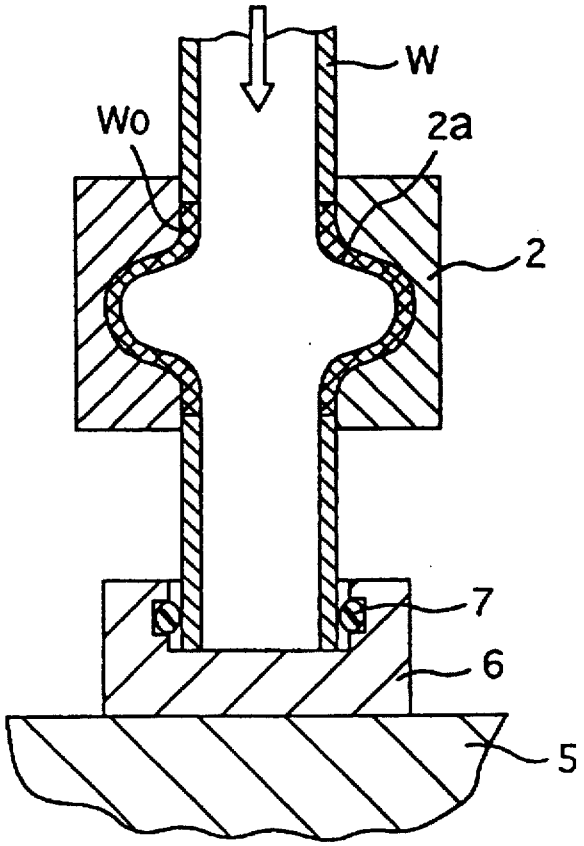
FIG. 15 is a cross section of a part of a pipe and a forming apparatus in an expansion step of a method according to a seventh preferred embodiment of the present invention.

First, a pipe W of the same kind as used in the Fourth Preferred Embodiment was prepared as shown in FIG. 15. This pipe W was attached to a pair of fixed chucks (not shown) of a forming apparatus. In this forming apparatus, a high frequency coil (not shown) was provided between the fixed chucks, and below the high frequency coil there was a forming die 2. Below the forming die 2, there was a sealing base 6. The pipe W was located in the high frequency coil, the forming die 2, and a circular hole 6*a* of the sealing base 6.

<The Heating Step>

A heated part $W_0$ having an axial length $l_0$ of 34 mm was formed on the pipe W by the high frequency coil in the same way as in the First Preferred Embodiment.

<The Expansion Step>

Immediately after the heating step, the pipe W was moved in the axial direction so as to locate the heated part $W_0$ within a forming surface 2*a* of the forming die 2, and the forming die 2 was closed. While compressed air at 10 $kgf/cm^2$ was supplied from an upper end of the pipe W, an axial compressive stress was applied to the pipe W. The forming allowance was 10 mm, and the loading speed was 200 mm/sec. Thus, the heated part $W_0$ was expanded while restricted by the forming surface 2*a*.

As a result, the method of this preferred embodiment further improved the tube expansion ratio.

Figure 16:
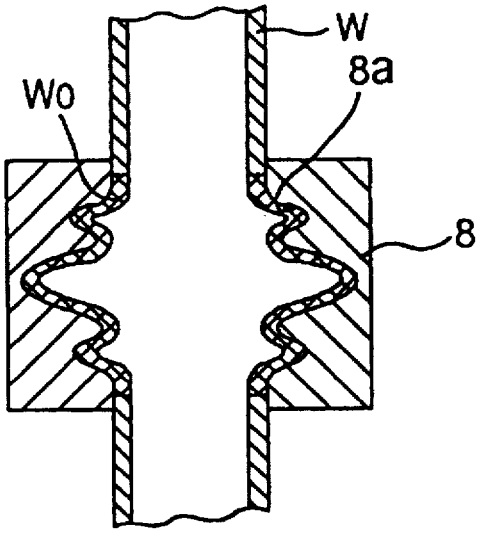
FIG. 16 is a cross section of a part of a pipe in an expansion step of a method according to a modification of the preferred embodiments of the present invention.
Figure 17:
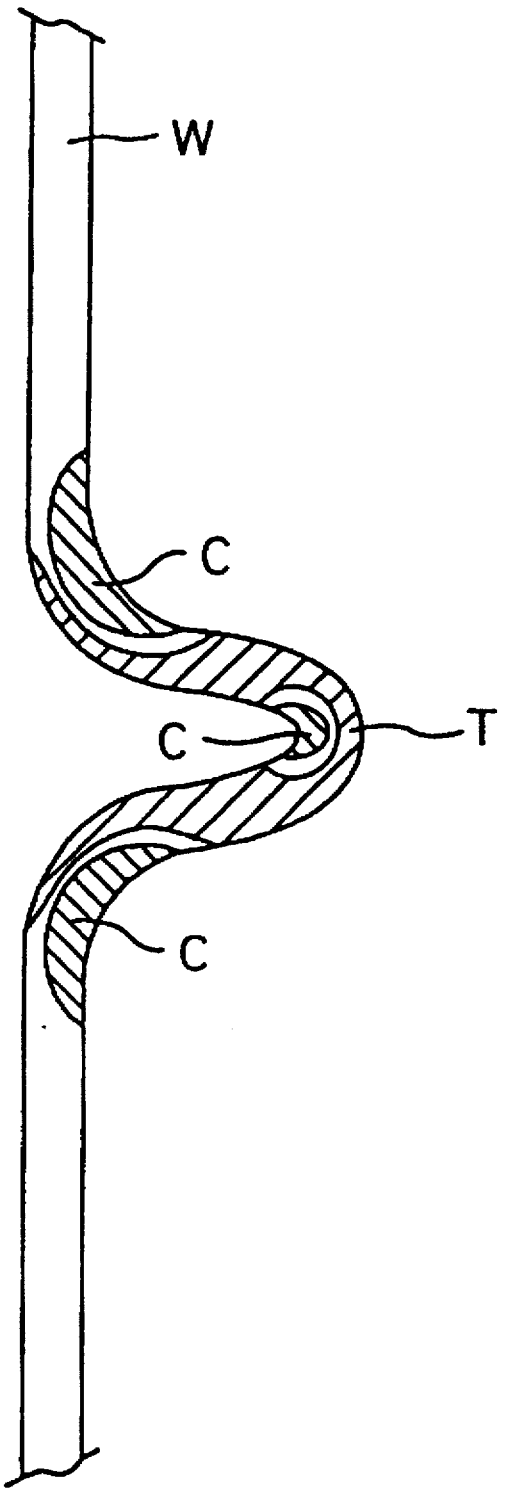
FIG. 17 is a schematic view showing how tensile stress and compressive stress are exerted on a pipe.

When a forming die 8 having a forming surface 8*a* in a complicated shape was employed in a similar method to the methods of the First and Seventh Preferred Embodiments, as shown in FIG. 16, an improvement in the surface area of the pipe W was achieved.

Obviously, many modifications and variations of the present invention are possible in the light of the above teachings. It is therefore to be understood that within the scope of the appended claims, the invention may be practiced otherwise than as specifically described.

What is claimed is:

1. A method for corrugating a metallic pipe, comprising:

a heating step of heating in a circumferential direction a local part of an outer periphery of a metallic pipe extending in an axial direction so as to form a heated part;

a first expansion step of placing on the side of said outer periphery of said pipe a contact jig which has a pair of inner end surfaces which are aligned with each other in said axial direction and serve as contact surfaces, and contacting each of said contact surfaces with said heated part so as to cross a particular portion of said heated part, while applying a first compressive stress to said pipe in said axial direction, so that said heated part is first expanded; and immediately after said first expansion step, a second expansion step of releasing said heated part from said contact with each of said contact surfaces and applying a second compressive stress to said pipe in said axial directions, so that said heated part is further expanded.

2. A method for corrugating a metallic pipe, comprising:

a first heating step of heating in a circumferential direction a local part of an outer periphery of metallic pipe extending in an axial direction, so as to form a first heated part;

a first expansion step of applying a first compressive stress to said pipe in said axial direction, so as to expand said first heated part first;

a second heating step of heating, in a circumferential direction, both said first heated part and portions at both axial sides of said first heated part, so as to form a second heated part; and a second expansion step of applying a second compressive stress to said pipe in said axial direction, so as to expand said second heated part second.

* * * * *